US009939773B2

(12) United States Patent
Hanayama

(10) Patent No.: US 9,939,773 B2
(45) Date of Patent: Apr. 10, 2018

(54) IMAGE PROCESSING APPARATUS

(71) Applicant: BROTHER KOGYO KABUSHIKI KAISHA, Nagoya-shi, Aichi-ken (JP)

(72) Inventor: Yukiyoshi Hanayama, Inazawa (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/474,202

(22) Filed: Mar. 30, 2017

(65) Prior Publication Data

US 2017/0364022 A1 Dec. 21, 2017

(30) Foreign Application Priority Data

Jun. 15, 2016 (JP) ..... 2016-119096

(51) Int. Cl.
*G03G 15/00* (2006.01)
*B41J 23/32* (2006.01)

(52) U.S. Cl.
CPC ..... *G03G 15/80* (2013.01); *B41J 23/32* (2013.01)

(58) Field of Classification Search
CPC ..... B41J 23/32; G03G 15/80
USPC ..... 399/88
See application file for complete search history.

(56) References Cited

U.S. PATENT DOCUMENTS

2005/0050371 A1 3/2005 Ono
2014/0340699 A1* 11/2014 Nakano ..... G06K 15/4055 358/1.13
2016/0062302 A1* 3/2016 Kim ..... G03G 15/80 399/88

FOREIGN PATENT DOCUMENTS

JP 2004-38725 A 2/2004
JP 2005-71274 A 3/2005
JP 2005-149211 A 6/2005
JP 2007-216619 A 8/2007
JP 2010-204727 A 9/2010
JP 2014-67101 A 4/2014

* cited by examiner

*Primary Examiner* — Sandra Brase
(74) *Attorney, Agent, or Firm* — Scully, Scott, Murphy & Presser, P.C.

(57) ABSTRACT

In an image processing apparatus, a power switcher starts supplying power in a second mode in which the power is supplied to a controller but not supplied to an image processor, when a state in which the power switcher receives no power is changed to a state in which the power switcher receives power. When a state in which no power is supplied to the controller is switched to a state in which power is supplied to the controller in the second mode and when the power switcher is receiving no power from a commercial power source, the controller, based on particular information, switches, before a first processing, a power supply mode from the second mode to a first mode in which no power is supplied or switches the power supply mode from the second mode to the first mode after the first processing.

14 Claims, 7 Drawing Sheets

FIG.3

| MODE | CONTROLLER | IMAGE PROCESSOR |
|---|---|---|
| FIRST MODE | NOT SUPPLY | NOT SUPPLY |
| SECOND MODE | SUPPLY | NOT SUPPLY |
| THIRD MODE | SUPPLY | SUPPLY |

IMAGE PROCESSING APPARATUS

CROSS REFERENCE TO RELATED APPLICATION

The present application claims priority from Japanese Patent Application No. 2016-119096, which was filed on Jun. 15, 2016, the disclosure of which is herein incorporated by reference in its entirety.

BACKGROUND

The following disclosure relates to an image processing apparatus configured to perform an image processing. In particular, the following disclosure relates to a technique for activating a controller using electric power supplied from a power source of a bus-connected device in an image processing apparatus capable of receiving the electric power supplied from the power source of the bus-connected device.

There have been known image processing apparatuses capable of receiving electric power supplied from power source of a bus-connected device which is connected to the image processing apparatus via a bus. Some image processing apparatuses have a mode in which a controller such as a CPU is activated without using electric power supplied from a commercial power source, based on the electric power supplied from the power source of the bus-connected device. This mode is effective when data is rewritten, at shipment from a factory, for a packed image processing apparatus to which it is difficult to supply the electric power from the commercial power source, for example.

As a technique using this mode, there is known a configuration in which an image forming apparatus and a personal computer (PC) are connected to each other via a USB interface, electric power is supplied from the PC to the image forming apparatus via the USB interface, and a firmware of the image forming apparatus is updated without connection to a commercial power source.

SUMMARY

However, there is a problem in the conventional technique. That is, since image processing cannot be performed only by the electric power supplied from the power source of the bus-connected device, a user need not use the above-described mode in a user environment after shipment. On the other hand, the above-described mode can be used even after the shipment. Thus, if the user unintentionally activates a controller in the above-described mode, useless electric power supplied from the power source of the bus-connected device is consumed.

Accordingly, an aspect of the disclosure relates to a technique for reducing useless power consumption in an image processing apparatus having a mode in which a controller is activated based on electric power supplied from a power source of a bus-connected device.

In one aspect of the disclosure, an image processing apparatus includes: an image processor configured to perform image processing; a storage; a power switcher including (i) a first connector connected to a commercial power source to receive electric power and (ii) a second connector connected to a power source of a bus-connected device to receive electric power; and a controller. The power switcher is selectively in one of at least three power supply modes, each of which is a mode of supply of the electric power from at least one of the commercial power source and the bus-connected device. The at least three power supply modes include: a first mode in which no electric power is supplied to any of the controller and the image processor, a second mode in which the electric power is supplied to the controller, and no electric power is supplied to the image processor; and a third mode in which the electric power is supplied to the controller and the image processor. The power switcher is configured to start supplying the electric power in the second mode when a state of the power switcher is changed from a state in which the power switcher receives no electric power from any of the commercial power source and the power source of the bus-connected device, to a state in which the power switcher receives the electric power from at least one of the commercial power source and the power source of the bus-connected device. The controller is configured to: determine whether the power switcher is receiving the electric power from the commercial power source, when a state of the controller is switched from a state in which no electric power is supplied to the controller to a state in which the electric power is supplied to the controller in the second mode; and when the controller determines that the power switcher is receiving no electric power from the commercial power source, execute, based on particular information stored in the storage, one of (a) switching the power supply mode of the power switcher from the second mode to the first mode before execution of a first processing and (b) switching the power supply mode of the power switcher from the second mode to the first mode after execution of the first processing.

In another aspect of the disclosure, an image processing apparatus includes: an image processor configured to perform image processing; a storage; a power switcher including (i) a first connector connected to a commercial power source to receive electric power and (ii) a second connector connected to a power source of a bus-connected device to receive electric power; and a controller. The power switcher is selectively in one of at least three power supply modes, each of which is a mode of supply of the electric power from at least one of the commercial power source and the bus-connected device. The at least three power supply modes include: a first mode in which no electric power is supplied to any of the controller and the image processor; a second mode in which the electric power is supplied to the controller, and no electric power is supplied to the image processor, and a third mode in which the electric power is supplied to the controller and the image processor. The power switcher is configured to start supplying the electric power in the second mode when a state of the power switcher is changed from a state in which the power switcher receives no electric power from any of the commercial power source and the power source of the bus-connected device, to a state in which the power switcher receives the electric power from at least one of the commercial power source and the power source of the bus-connected device. The controller is configured to: determine whether the power switcher is receiving the electric power from the commercial power source, when a state of the controller is switched from a state in which no electric power is supplied to the controller to a state in which the electric power is supplied to the controller, determine, based on particular information stored in the storage, whether the power supply mode of the power switcher is to be changed to the first mode before execution of a first processing or after execution of the first processing; switch the power supply mode of the power switcher from the second mode to the first mode before execution of the first processing, when the controller determines that the power switcher is receiving no electric power from the commercial power source and when the controller determines that the power supply mode of the power switcher is to be changed to the first mode before execution of the first processing; and switch the power supply mode of the power switcher from the second mode to the first mode after execution of the first processing, when the controller determines that the power switcher is receiving no electric power from the commercial power source and when the controller determines that the power supply mode of the power switcher is to be changed to the first mode after execution of the first processing.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which:

FIG. 3 is a table for explaining a device or devices to which electric power is to be supplied in each of modes;

DETAILED DESCRIPTION OF THE EMBODIMENT

Hereinafter, there will be described an image processing apparatus according to one embodiment by reference to the drawings. One example of the image processing apparatus is a multi-function peripheral (MFP) 100 having an image processing function and configured to receive electric power supplied from a power source of a device connected to the MFP 100 via a bus.

Figure 1:
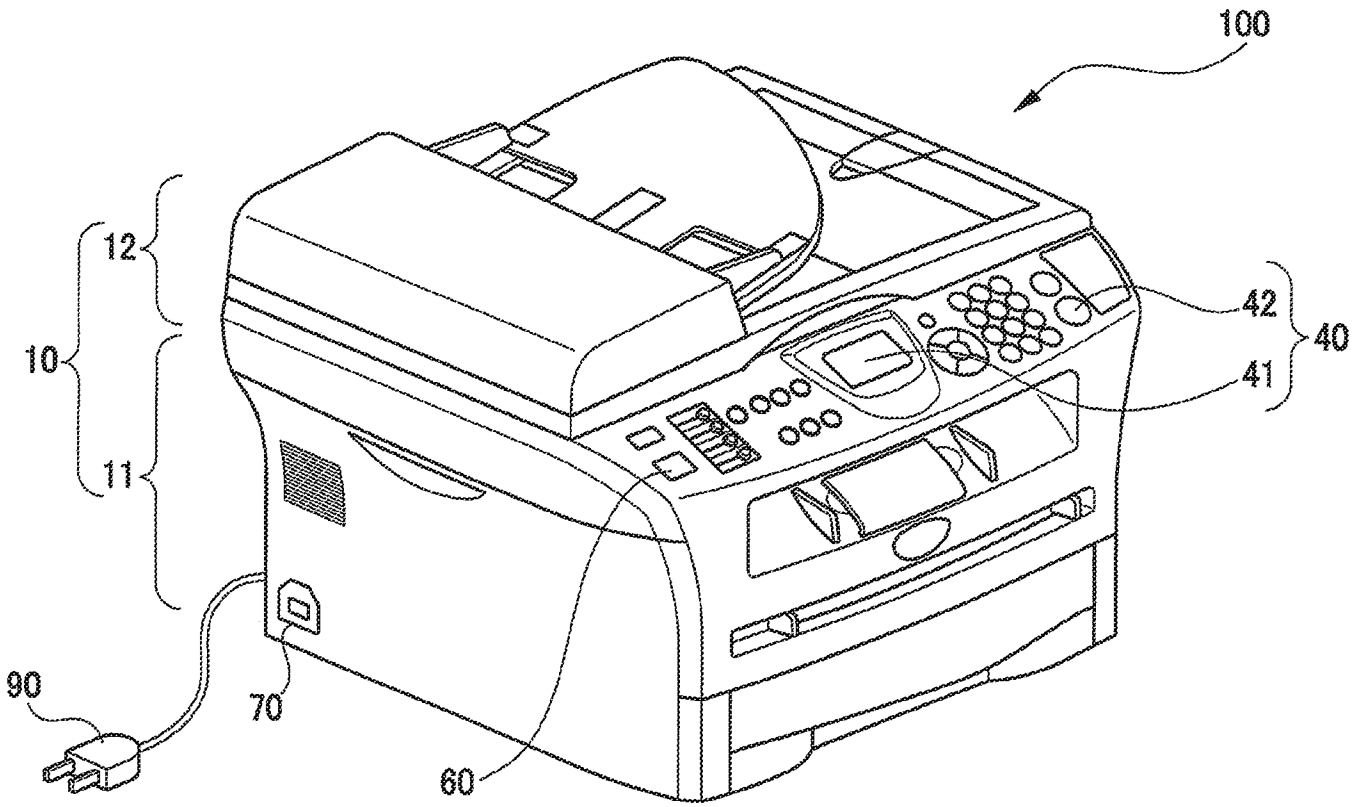
FIG. 1 is a perspective view of a multi-function peripheral (MFP) according to one embodiment.

As illustrated in FIG. 1, the MFP 100 includes an image processor 10, an operation panel 40, a power-source key 60, a USB connector 70, and a power-source plug 90. The image processor 10 includes an image former 11 and an image reader 12. When the power-source plug 90 is inserted into a receptacle for supplying electric power from a commercial power source, the MFP 100 receives the electric power supplied from the commercial power source. The power-source plug 90 is one example of a first connector.

The image former 11 is configured to print an image on a sheet. The image former 11 may be any of an electronic photographic image forming device and an ink-jet image forming device. The MFP 100 may be any of an apparatus capable of forming color images and an apparatus only capable of forming monochrome images. The MFP 100 may be any of an apparatus capable of performing duplex printing and an apparatus only capable of performing simplex printing.

The image reader 12 is configured to read an image formed on a document. The image reading may be performed using any of a charged-coupled device (CCD) and a contact image sensor (CIS). The MFP 100 may be any of an apparatus capable of performing color reading and an apparatus only capable of performing black and white reading. The MFP 100 may be any of an apparatus capable of performing duplex reading and an apparatus only capable of performing simplex reading. Furthermore, the MFP 100 may or may not include an automatic document feeder.

As illustrated in FIG. 1, the operation panel 40 includes a liquid crystal display 41 and a button group 42. The MFP 100 controls the liquid crystal display 41 of the operation panel 40 to display various kinds of information and a state of the MFP 100. The button group 42 includes an execution button, a cancel button, and a numeric keypad. A user operates the button group 42 to instruct the MFP 100 to control the image processor 10.

As will be described below, the power-source key 60 is interlocked with a momentary switch in the form of a fifth switch 56 (see FIG. 2). That is, the fifth switch 56 is in a conducting state only in a period in which the power-source key 60 is being operated by the user, and the fifth switch 56 is in a non-conducting state in a period in which the power-source key 60 is not operated by the user. When the power-source key 60 is operated, the MFP 100 switches a state of supply of the electric power to the image processor 10. The power-source key 60 will be described later in detail.

The USB connector 70 is what is called a USB type-B receptacle which is an opening for insertion of a USB plug according to USB standard. When a USB cable provided with a USB type-B plug is inserted into the USB connector 70, the MFP 100 is connected to a host device, such as a personal computer (PC) via the USB cable. The MFP 100 is capable of receiving electric power at about 5 V from the host device through the USB cable in a state in which the host device is connected to the USB connector 70. The USB connector 70 is one example of a second connector. The host device connected to the USB connector 70 is one example of the power source of the device connected via the bus.

The USB connector 70 has an interface function according to USB standard. The MFP 100 performs plug-and-play (PnP) response, for example. That is, the MFP 100 transmits a response signal to the host device in response to a response request signal transmitted from the host device, so that communication between the MFP 100 and the host device is established. In the following description, connection via the USB connector 70 may be referred to as "USB connection".

There will be next described an electric configuration of the MFP 100. As illustrated in FIG. 2, the MFP 100 includes a controller 30. The controller 30 includes a CPU 31, a ROM 32, a RAM 33, and a non-volatile memory 34. The MFP 100 further includes the image processor 10, the operation panel 40, and a power switcher 50, which are electrically connected to the controller 30. In FIG. 2, the bold arrows indicate an electric power system and directions of supply of the electric power. Also, thin arrows indicate a signal system.

The ROM 32 stores various kinds of control programs, settings, initial values, and other similar information for controlling the MFP 100. The RAM 33 is used as a working area from which the various kinds of control programs are read or as a storage area for temporarily storing data. The non-volatile memory 34 is used as an area for storing data, various settings, and other similar information. Examples of the non-volatile memory 34 include an EEPROM and a flash memory.

The non-volatile memory 34 stores switch information 341. The switch information 341 indicates whether a mode of supply of the electric power (hereinafter may be referred to as "power supply mode") which will be described below is to be switched to a first mode immediately. That is, the switch information 341 indicates whether the CPU 31 immediately switches the power supply mode to the first mode before execution of a particular processing or keeps a second mode until execution of the particular processing and switches the power supply mode to the first mode after execution of the particular processing. First information or second information is stored in the non-volatile memory 34 as the switch information 341. That is, when the switch information 341 is the first information, the switch information 341 indicates that the CPU 31 switches the power supply mode to the first mode before execution of the particular processing, and when the switch information 341 is the second information, the switch information 341 indicates that the CPU 31 switches the power supply mode to the first mode after execution of the particular processing. The particular processing executed by the CPU 31 is one of various kinds of processings to be executed in a second mode process in FIG. 6 which will be described below. The switch information 341 will be described later in detail. The non-volatile memory 34 is one example of a storage. The switch information 341 is one example of particular information. Each of the processings to be executed by the CPU 31 in the second mode process is one example of a first processing. In the present embodiment, at a time just after a manufacture of the MFP 100, the non-volatile memory 34 stores the second information as an initial value of the switch information 341.

The CPU 31 controls the devices of the MFP 100 according to the control program read from the ROM 32 while storing results of processings into the RAM 33 or the non-volatile memory 34. The CPU 31 is one example of a controller. The controller 30 is another example of the controller. The controller 30 in FIG. 2 is a generic collective name for various kinds of hardware used for control of the MFP 100 such as the CPU 31 and may not be a single piece of hardware provided in the MFP 100 in reality.

Figure 2:
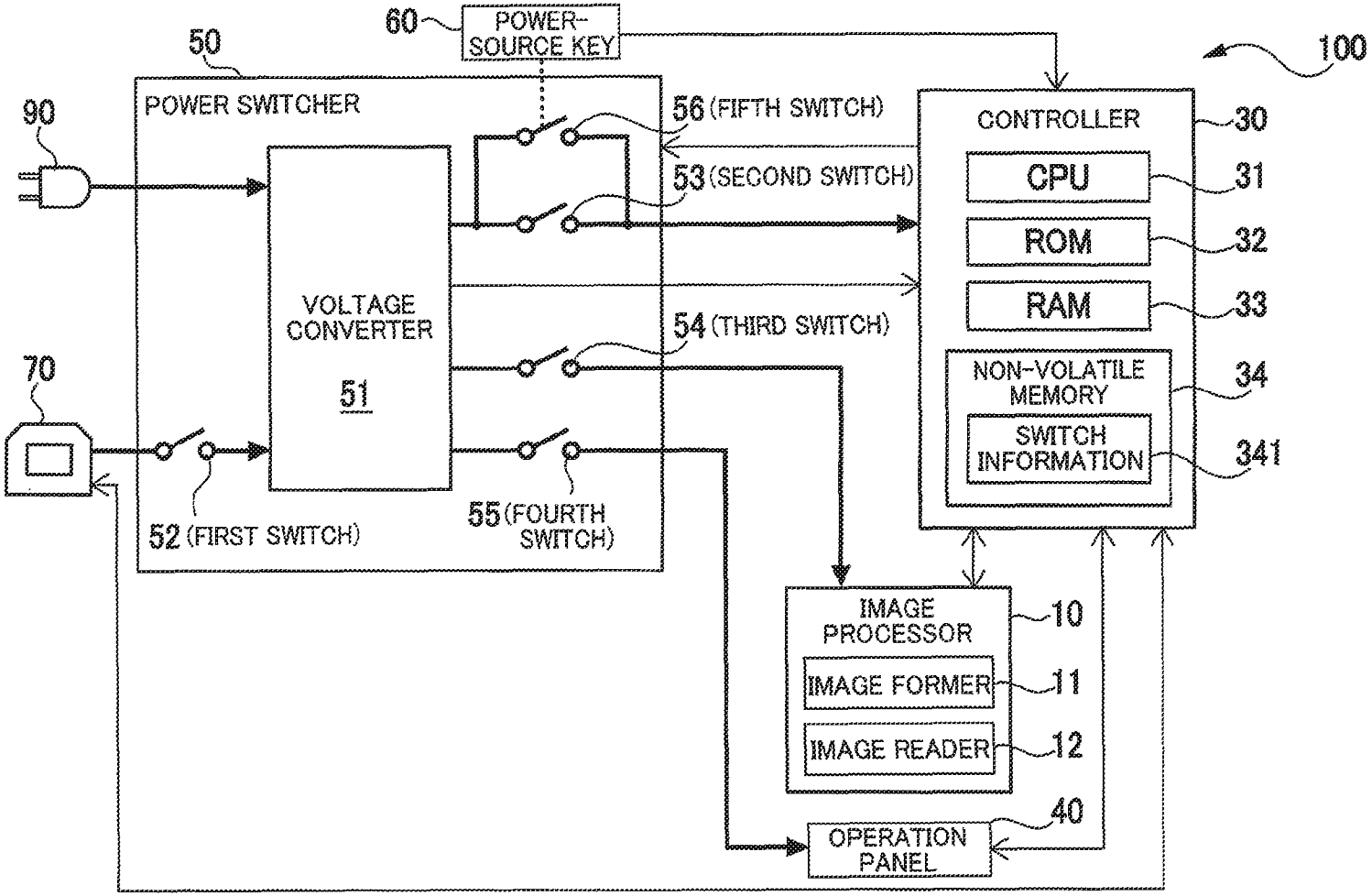
FIG. 2 is a block diagram illustrating an electric configuration of the MFP.

As illustrated in FIG. 2, the power switcher 50 includes a voltage converter 51 and five switches. The five switches include a first switch 52, a second switch 53, a third switch 54, a fourth switch 55, and the fifth switch 56. The power switcher 50 receives the electric power from the commercial power source via the power-source plug 90 and the electric power from the host device connected via the USB connector 70. The power switcher 50 supplies the electric power to the controller 30, the image processor 10, and the operation panel 40. The voltage converter 51 converts the voltage of the supplied electric power to a voltage required in a device to which the electric power is supplied. The voltage converter 51 outputs the electric power at the converted voltage.

As illustrated in FIG. 2, each of the switches 52-55 of the power switcher 50 is an alternate switch that opens and closes a corresponding path through which the electric power is supplied (hereinafter may be referred to as "power supply path"). Specifically, the first switch 52 opens and closes a power supply path extending from the USB-connected host device to the voltage converter 51. The second switch 53 opens and closes a power supply path extending from the voltage converter 51 to the controller 30. The third switch 54 opens and closes a power supply path extending from the voltage converter 51 to the image processor 10. The fourth switch 55 opens and closes a power supply path extending from the voltage converter 51 to the operation panel 40. In the following description, a closed state of each of the switches 52-55 is a state in which the corresponding power supply path is conducting to enable supply of the electric power. On the other hand, an open state of each of the switches 52-55 is a state in which the corresponding power supply path is not conducting to inhibit the supply of the electric power.

Each of the switches 52-55 may be in any of the open state and the closed state when no electric power is supplied to the power switcher 50. The open or closed states of the switches 52-55 are reset to their respective initial states when the state in which no electric power is supplied to the power switcher 50 is switched to the state in which the electric power is supplied to the power switcher 50. The electric power supplied to the power switcher 50 may be supplied from the power-source plug 90 and may be supplied from the USB connector 70. In the present embodiment, the initial state of each of the first switch 52 and the second switch 53 is the closed state, and the initial state of each of the third switch 54 and the fourth switch 55 is the open state.

The state of each of the switches 52-55 is switched by the power switcher 50 based on a control signal transmitted from the controller 30. When the electric power is kept supplied to the power switcher 50, each of the switches 52-55 is kept in the switched state until the next control signal is received from the controller 30. The switches 52-55 are switched to their respective initial states in the case where, after the switch, a state in which no electric power is supplied to the power switcher 50 is temporarily established, and then this state is changed to the state in which the electric power is supplied to the power switcher 50.

As described above, the fifth switch 56 is a momentary switch which is opened and closed by the power-source key 60. Thus, during operation of the power-source key 60, the state of the power supply path extending from the voltage converter 51 to the controller 30 is kept in the conducting state by the fifth switch 56 regardless of the open or closed state of the second switch 53. When the power-source key 60 is operated, a signal indicating the operation is input to the controller 30. It is noted that each of the switches 52-56 in FIG. 2 is schematically illustrated for easy understanding of a configuration for switching the electrically connecting state. Examples of the switches 52-56 include: a component configured to mechanically switch the state, such as a relay; and a semiconductor switch constituted by a power FET or a power transistor, for example.

There will be next explained the power supply mode in the MFP 100. As illustrated in FIG. 3, the power supply mode includes three modes by way of example. The word "SUPPLY" in FIG. 3 indicates that the electric power is supplied, and the word "NOT SUPPLY" indicates that the electric power is not supplied. In the first mode, no electric power is supplied to the controller 30 and the image processor 10. In the second mode, the electric power is supplied to the controller 30 but is not supplied to the image processor 10. In a third mode, the electric power is supplied to both of the controller 30 and the image processor 10.

In the first mode, both of the second switch 53 and the third switch 54 are open. In the second mode, the second switch 53 is closed, and the third switch 54 is open. In the third mode, both of the second switch 53 and the third switch 54 are closed.

In the third mode, the fourth switch 55 is also closed to supply the electric power to the operation panel 40. Each of the first mode and the second mode may include: a mode in which the fourth switch 55 is closed to supply the electric power to the operation panel 40; and a mode in which the fourth switch 55 is opened to supply no electric power to the operation panel 40.

In the present embodiment, when the electric power is supplied to the image processor 10, the electric power is also supplied to the operation panel 40, and when no electric power is supplied to the image processor 10, no electric power is supplied to the operation panel 40, either. That is, the fourth switch 55 and the third switch 54 are always in the same open or closed state in the present embodiment. It is noted that the devices to which the electric power is to be supplied may include not only the controller 30, the image processor 10, and the operation panel 40 but also another device. In this case, a switch may be provided for a power supply path extending to said another device.

Figure 4:
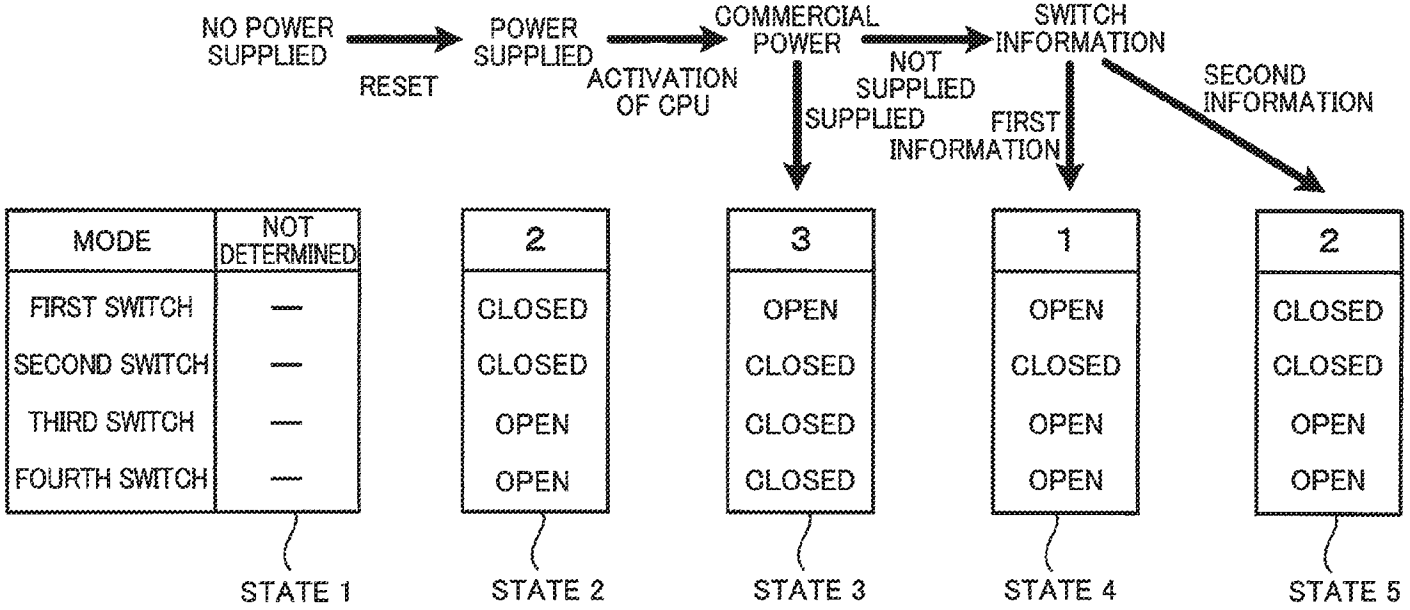
FIG. 4 is a view for explaining a procedure of transition of the power supply mode.

In this MFP 100, as illustrated in FIG. 4, the power supply mode makes a transition depending upon conditions. FIG. 4 is a view for explaining a procedure of transition of the power supply mode and states of the switches 52-55. As indicated by STATE 1 in FIG. 4, the states of the respective switches 52-55 and the supply mode are not determined in the state in which no electric power is supplied to the MFP 100 from any of the power-source plug 90 and the USB connector 70. Since no electric power is supplied from outside in this state, the MFP 100 does not supply the electric power to any component in the MFP 100.

In the case where the power-source plug 90 is inserted into the receptacle in STATE 1, the electric power is supplied from the commercial power source to the power switcher 50 of the MFP 100. In the case where the host device is connected to the USB connector 70 in STATE 1, the electric power is supplied from the host device to the power switcher 50 of the MFP 100.

When the electric power is received from the power-source plug 90 or the USB connector 70, the MFP 100 resets the open or closed states of the respective switches as described above, and STATE 2 in FIG. 4 is established. In STATE 2, the first switch 52 and the second switch 53 are closed, and the third switch 54 and the fourth switch 55 are open. Since the second switch 53 is closed, the power switcher 50 supplies the electric power to the controller 30. Since the third switch 54 and the fourth switch 55 are open, the power switcher 50 supplies no electric power to the image processor 10 and the operation panel 40. That is, upon receiving the electric power in the state in which the electric power is not received, the power switcher 50 starts supplying the electric power in the second mode.

The electric power starts to be supplied in the second mode in the state in which no electric power is received, and the electric power is supplied to the controller 30, whereby the CPU 31 is activated. Upon activation, the CPU 31 starts executing a mode transition process that is set to be executed upon activation. In the mode transition process, the CPU 31 executes (i) first determination for determining whether the power switcher 50 is receiving the electric power from the commercial power source and (ii) second determination for determining whether the switch information 341 is the first information. As illustrated in FIG. 4, the CPU 31 switches the power supply mode based on results of the first determination and the second determination. The mode transition process will be described later in detail.

When the CPU 31 determines in the first determination that the electric power is supplied from the commercial power source, as indicated by STATE 3 in FIG. 4, the CPU 31 switches the power supply mode to the third mode. Specifically, the CPU 31 sends the power switcher 50 a signal for switching the first switch 52 to the open state and switching each of the third switch 54 and the fourth switch 55 to the closed state. Upon receiving this signal, the power switcher 50 supplies the electric power supplied from the commercial power source, to the controller 30, the image processor 10, and the operation panel 40. In the case where the electric power is received from the commercial power source, the MFP 100 does not receive the electric power supplied from the host device.

When the CPU 31 determines in the first determination that the power switcher 50 is receiving no electric power supplied from the commercial power source and determines in the second determination that the switch information 341 is the first information, the power supply mode is switched to the first mode as indicated by STATE 4 in FIG. 4. Specifically, the CPU 31 sends the power switcher 50 a signal for switching the first switch 52 to the open state. As a result, the power switcher 50 receives no electric power from any of the commercial power source and the host device. Accordingly, the power switcher 50 does not supply the electric power to the controller 30 and the image processor 10.

When the CPU 31 determines in the first determination that the power switcher 50 is receiving no electric power supplied from the commercial power source and determines in the second determination that the switch information 341 is not the first information but the second information, as indicated by STATE 5 in FIG. 4, the power supply mode is kept to be the second mode until the particular processing is executed. Specifically, the CPU 31 transmits no signal for switching the switches. Thus, the power switcher 50 receives the electric power from the host device and supplies the electric power to the controller 30 but does not supply the electric power to the image processor 10. When the USB plug is removed from the USB connector 70 during operation in STATE 5, the MFP 100 ceases receiving the electric power, so that the supply of the electric power to the controller 30 is stopped.

Figure 5:
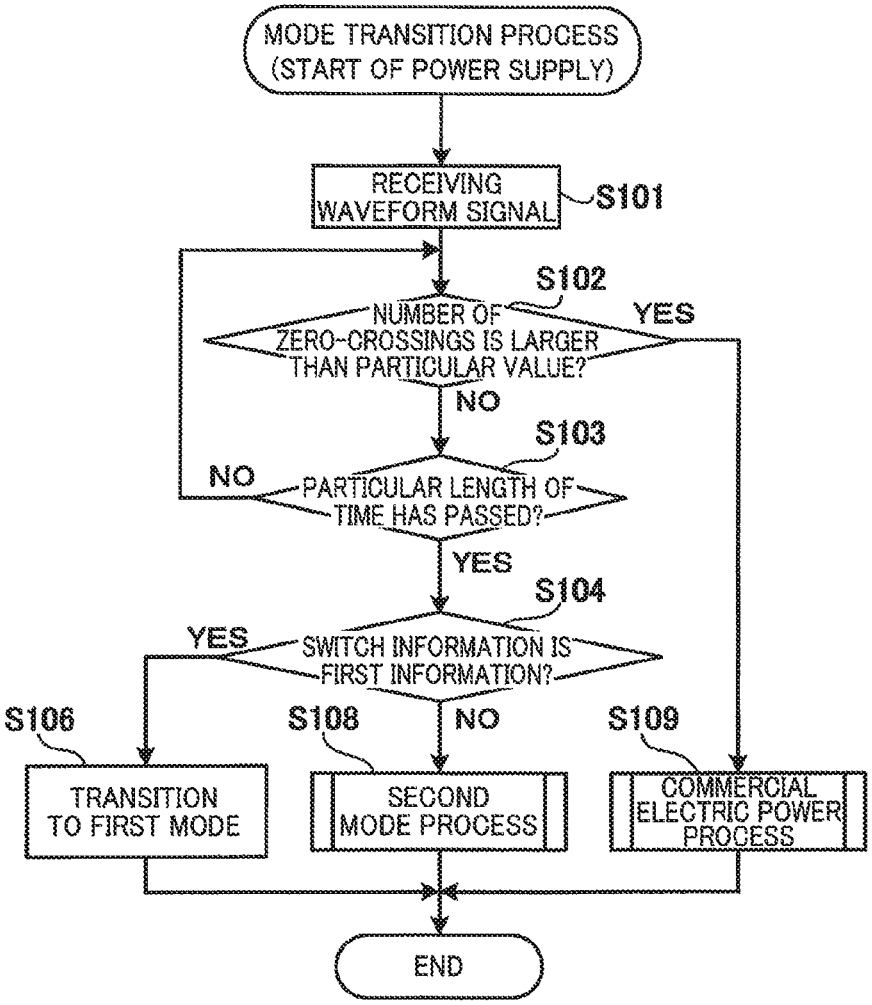
FIG. 5 is a flow chart illustrating a procedure of a mode transition process.

There will be next explained, with reference to the flow chart in FIG. 5, a procedure of the mode transition process for performing the above-described power switching operations in the MFP 100. The CPU 31 executes this mode transition process when the MFP 100 receives the electric power in the state in which the MFP 100 receives no electric power. That is, the CPU 31 executes this mode transition process when the electric power is supplied to the controller 30, and the CPU 31 is activated. At the start of the mode transition process, the power supply mode is the second mode, the electric power is supplied to the controller 30, and no electric power is supplied to the image processor 10.

The mode transition process begins with S101 at which the CPU 31 receives a waveform signal from the voltage converter 51 of the power switcher 50 to determine whether the power switcher 50 is receiving the electric power supplied from the commercial power source. The voltage converter 51 is configured to create a waveform signal for detecting a zero-crossing based on the supplied electric power, for example. The zero-crossing is a timing when an absolute value of an alternating voltage is zero, that is, there is no voltage present in the waveform signal. The CPU 31 detects the zero-crossing based on the waveform signal received from the voltage converter 51.

In the case where alternating-current electric power is input from the commercial power source to the power switcher 50, a plurality of zero-crossings are detected from the received waveform signal. In the case where the power switcher 50 receives the electric power from the commercial power source, the number of zero-crossings detected from the waveform signal per unit time is larger than a particular value. Thus, the CPU 31 detects the zero-crossings based on the waveform signal received within a particular length of time and determines that the power switcher 50 is receiving the electric power from the commercial power source when the number of the zero-crossings per unit time is larger than the particular value. One example of the particular length of time is 100 ms, one example of the particular value is five.

The CPU 31 at S102 determines whether the number of zero-crossings detected from the waveform signal per unit time is larger than the particular value. When the CPU 31 determines that the number of the zero-crossings is smaller than or equal to the particular value (S102: NO), the CPU 31 at S103 determines whether the particular length of time has passed. When the particular length of time has not passed (S103: NO), the CPU 31 continues receiving the waveform signal.

When the CPU 31 determines that the particular length of time has passed in a state in which the number of the zero-crossings is not larger than the particular value (S103: YES), the CPU 31 at S104 determines whether the switch information 341 stored in the non-volatile memory 34 is the first information. In the case where the number of the zero-crossings is not larger than the particular value even when the particular length of time has passed, the CPU 31 determines that the power switcher 50 is not receiving the electric power from the commercial power source. That is, the electric power causing execution of the present process is supplied from the host device, and the MFP 100 is receiving only the electric power supplied from the host device. Thus, the CPU 31 determines whether an operation performed only by the electric power supplied from the host device is permitted.

In the case where the CPU 31 is activated by the electric power supplied only from the host device, a power consumption is preferably less than or equal to 2.5 W that is the upper limit of the electric power suppliable by the host device via USB. Thus, at the start of execution of the mode transition process, the controller 30 preferably supplies a smaller amount of the electric power to the image processor 10, supplies a smaller amount of the electric power to the operation panel 40, a network interface, and an SDRAM, and, in the case where the MFP 100 includes a plurality of CPUs, activates only one or some of the CPUs without activating all the CPUs, for example. With these operations, even in the case where the supplied electric power is only the electric power supplied from the host device, the CPU 31 is activated stably to execute the mode transition process.

When the CPU 31 at S104 determines that the switch information 341 is the first information (S104: YES), the CPU 31 at S106 switches the power supply mode from the second mode to the first mode, and this mode transition process ends. Specifically, as indicated by STATE 4 in FIG. 4, the CPU 31 instructs the power switcher 50 to switch the first switch 52 from the closed state to open state. When the first switch 52 is opened by the power switcher 50, no electric power is supplied to the controller 30, so that the CPU 31 cannot execute the process. Thus, the mode transition process ends.

When the CPU 31 determines that the switch information 341 is not the first information but the second information (S104: NO), the CPU 31 does not switch the power supply mode. That is, the CPU 31 does not transmit an instruction for switching the states of the switches 52-55. The CPU 31 continues its operations by the electric power supplied from the host device and at S108 executes the second mode process for operations in the second mode.

Figure 6:
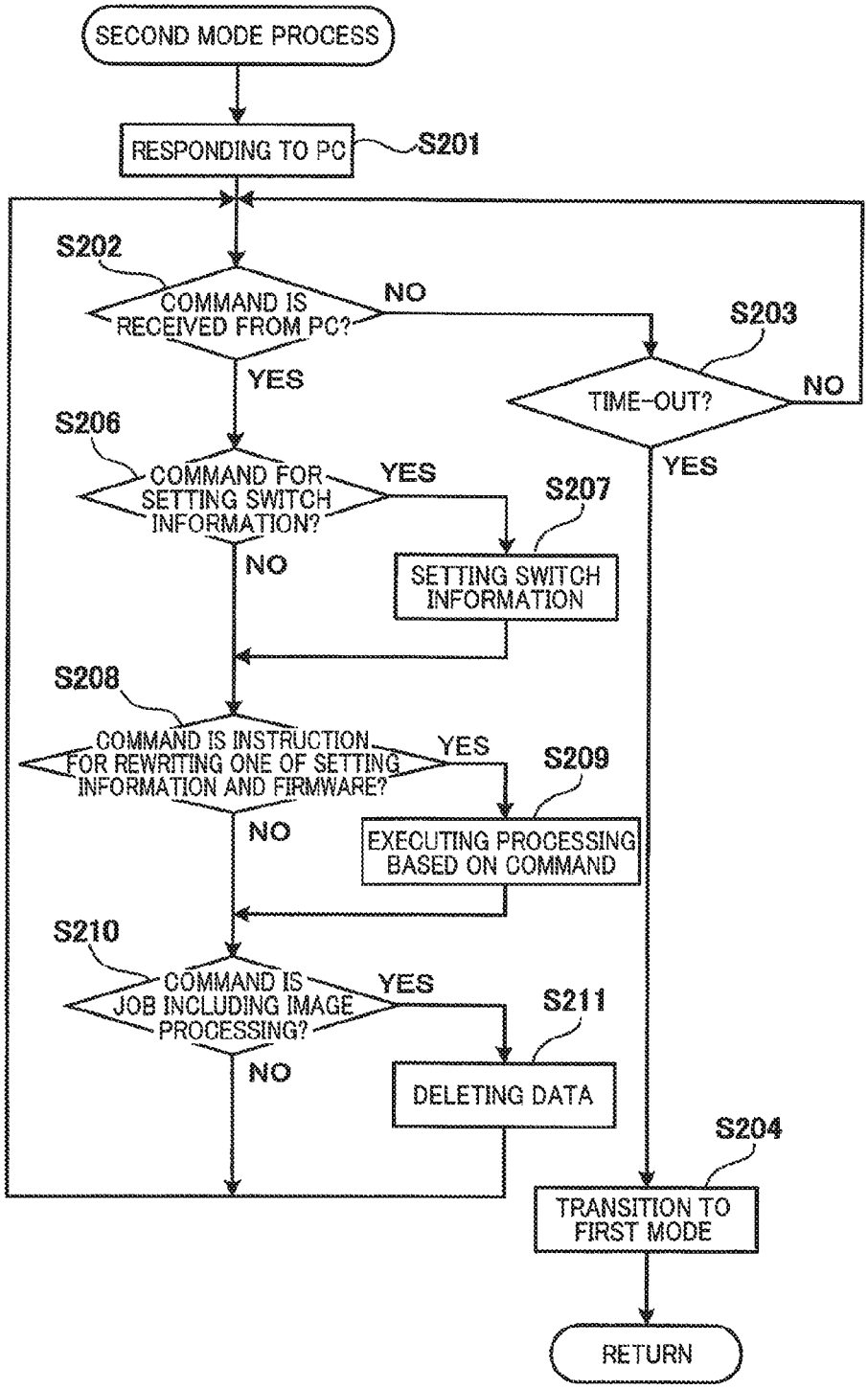
FIG. 6 is a flow chart illustrating a procedure of a second mode process.

There will be next explained, with reference to the flow chart in FIG. 6, a procedure of the second mode process executed by the CPU 31 when the power switcher 50 is receiving the electric power in the second mode. The second mode process is executed by the CPU 31 in the mode in which the electric power supplied from the host device connected to the USB connector 70 is supplied to the controller 30 and not supplied to the image processor 10 in the state in which the power switcher 50 is not receiving the electric power from the commercial power source.

The second mode process begins with S201 at which the CPU 31 transmits a response signal in response to a response request signal transmitted from the host device such as a USB-connected PC. The CPU 31 performs a PnP response via the USB connector 70, for example. This operation enables the MFP 100 to communicate with the host device connected thereto through USB. It is noted that the USB-connected host device in some cases transmits the response request signal from the timing just after the host device is connected to the MFP 100 through USB. However, the MFP 100 does not transmit the response signal until the CPU 31 determines that the supply of the electric power in the second mode is continued. Thus, the host device cannot recognize the MFP 100 until the CPU 31 determines that the supply of the electric power in the second mode is continued. Accordingly, in the case where the second mode is not continued, a display of the host device does not display a pop-up screen indicating that the USB device is connected.

The CPU 31 at S202 determines whether information such as a command has been received from the host device. When the CPU 31 determines that the information such as the command has not been received (S202: NO), the CPU 31 at S203 determines whether the state in which the information is not received has continued for a specific length of time, in other words, the CPU 31 determines whether a time-out has occurred. When the CPU 31 determines that the time-out has not occurred (S203: NO), this flow returns to S202.

When the time-out has occurred (S203: YES), the CPU 31 at S204 switches the power supply mode from the second mode to the first mode, and the second mode process ends. Specifically, as in the processing at S106 in the mode transition process, the CPU 31 instructs the power switcher 50 to switch the first switch 52 from the closed state to open state. As a result, no electric power is supplied to the CPU 31, and the second mode process ends.

If the CPU 31 waits for reception of the command in the second mode for a long time, there is a high possibility of a large power consumption which is not preferable in the state in which the MFP 100 receives the electric power only from the host device. Accordingly, when the CPU 31 determines that the time-out has occurred, the MFP 100 automatically disconnects the supply of the electric power from the USB-connected host device, thereby avoiding further power consumption.

When the CPU 31 determines that the command is received from the host device before the time-out has occurred (S202: YES), the CPU 31 at S206 determines whether the received command is a setting command for setting the switch information 341. When the CPU 31 determines that the received command is the setting command for setting the switch information 341 (S206: YES), the CPU 31 at S207 stores the first information or the second information as the switch information 341 in the non-volatile memory 34 according to designation of the setting command.

When a command for setting the switch information 341 to the first information is received during operation in the second mode, the MFP 100 is set such that the power supply mode is switched to the first mode at the next activation of the CPU 31 in the second mode without continued operation in the second mode. For example, in the case where the CPU 31 is activated in the second mode to rewrite a firmware or the like after manufacture of the MFP 100 and before its shipment, the switch information 341 is switched to the first information after the rewrite, whereby the MFP 100 thereafter does not accept a rewrite of the firmware or the like even when the host device is connected to the MFP 100. Alternatively, in the case where the switch information 341 is set to the first information before shipment of the MFP 100, it is possible to reduce occasions of operations in the second mode in a user environment.

After the processing at S207 or when the CPU 31 determines that the received command is not the setting command for setting the switch information 341 (S206: NO), the CPU 31 at S208 determines whether the received command is an instruction for rewriting one of setting information and the firmware, for example. When the CPU 31 determines that the received command is the instruction for rewriting one of the setting information and the firmware (S208: YES), the CPU 31 at S209 executes an instructed processing based on the received command. For example, when the command is the instruction for rewriting the firmware, the CPU 31 rewrites target information. That is, the CPU 31 rewrites information stored in the ROM 32 or the non-volatile memory 34, based on the instruction of the command.

After the processing at S209 or when the CPU 31 determines that the received command is not the instruction for rewriting one of the setting information and the firmware (S208: NO), the CPU 31 at S210 determines whether the received command is a job including image processing. When the CPU 31 determines that the received command is a job including image processing (S210: YES), the CPU 31 at S211 reads and deletes received data. Since supplied electric power is small in the second mode, there is a high possibility that image processing cannot be executed. Thus, in the case where a job including image processing is received in the second mode, a load imposed on the RAM 33 is smaller when the data is read and deleted than when the data is not deleted. It is noted that the CPU 31 may send the connected host device a signal indicating that the job is not to be executed.

After the processing at S211 or when the CPU 31 determines that the received command is not a job including image processing (S210: NO), this flow goes to S202 at which the CPU 31 waits for a command from the host device. This processing is continued until the CPU 31 determines that the time-out has occurred at S203. It is noted that the CPU 31 may receive, from the host device, not only the commands and the instructions in FIG. 6 but also other kinds of instructions and commands. For example, the CPU 31 may receive an instruction for terminating the second mode process.

It is noted that the CPU 31 is unable to execute the processings in the case where the supply of the electric power from the host device to the USB connector 70 ceases during execution of the second mode process, for example, in the case where the USB plug is removed from the USB connector 70 or in the case where a power source function of the host device is stopped. Also in this case, the second mode process is terminated.

Returning to explanation for the mode transition process in FIG. 5, when the CPU 31 at S102 determines that the number of the zero-crossings has exceeded the particular value before determining at S103 that the particular length of time has passed (S102: YES), the CPU 31 at S109 executes a commercial electric power process. When the number of zero-crossings detected from the waveform signal per unit time is larger than the particular value, the CPU 31 determines that the power switcher 50 is receiving the electric power supplied from the commercial power source. That is, the commercial electric power process is a process executed in the case where the power switcher 50 is receiving at least the electric power supplied from the commercial power source.

Figure 7:
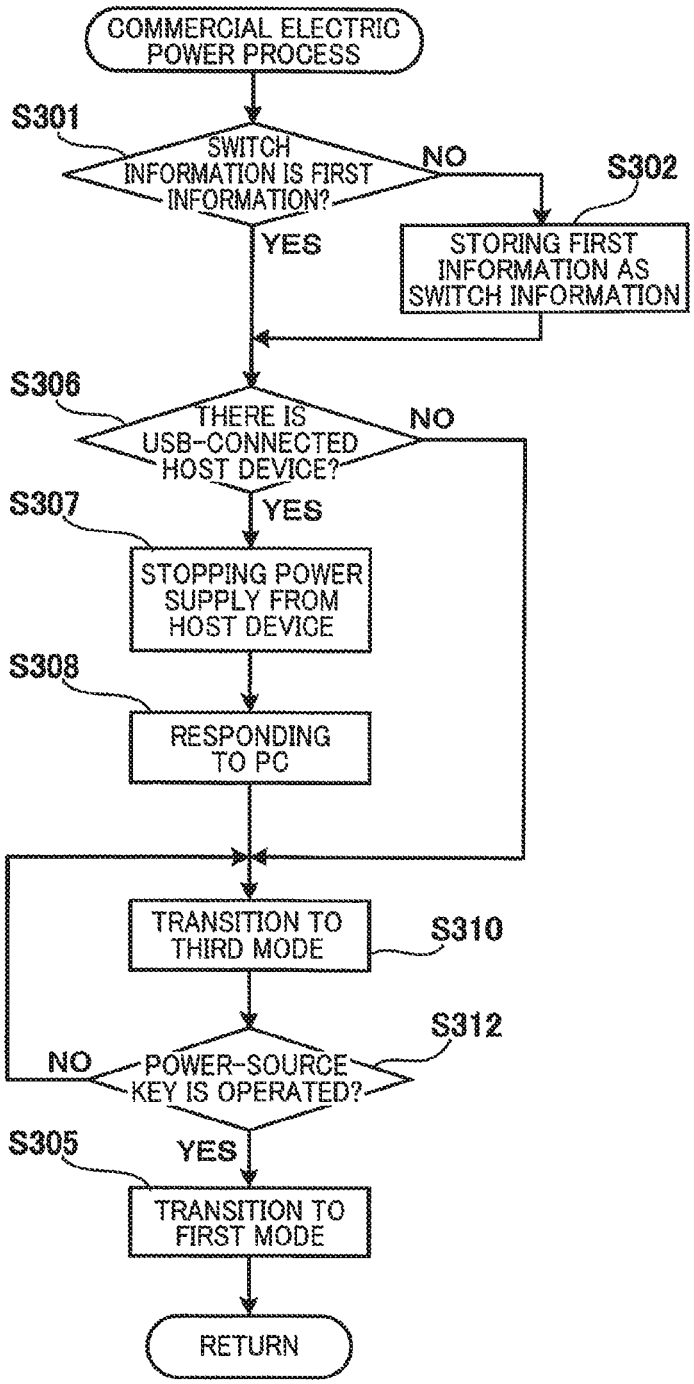
FIG. 7 is a flow chart illustrating a procedure of a commercial electric power process.

There will be next explained a procedure of the commercial electric power process with reference to the flow chart in FIG. 7. The commercial electric power process begins with S301 at which the CPU 31 determines whether the switch information 341 stored in the non-volatile memory 34 is the first information. When the CPU 31 determines that the switch information 341 is not the first information (S301: NO), the CPU 31 at S302 stores the first information as the switch information 341. That is, the CPU 31 stores, into the non-volatile memory 34, information indicating that the power supply mode is switched to the first mode. It is noted that the CPU 31 may omit the determination at S301 and rewrites and stores the first information into the non-volatile memory 34 as the switch information 341.

When the switch information 341 is the first information, as described above, the operations of the controller 30 by the electric power supplied from the USB-connected host device are limited. The MFP 100 stores the first information as the switch information 341 in the case where the controller 30 is activated using the commercial power source even once or in the case where the MFP 100 accepts an instruction contained in the command transmitted from the host device. For example, in the case where the electric power is supplied from the commercial power source, there is a high possibility that the MFP 100 is in the user environment. Thus, the CPU 31 sets the switch information 341 to the first information to limit further operations of the controller 30 in the second mode. It is noted that the MFP 100 may also receive an instruction for switching the switch information 341 to the first information via input from the operation panel 40.

After the processing at S302 or when the CPU 31 determines that the switch information 341 is the first information (S301: YES), the CPU 31 at S306 determines whether there is a host device connected to the MFP 100 through USB. A voltage signal is input from the host device to the power switcher 50 in a state in which the host device is connected to the USB connector 70. Thus, the CPU 31 executes the determination at S306 based on whether the voltage signal is input to the power switcher 50.

When the CPU 31 determines that there is a host device connected to the MFP 100 through USB (S306: YES), the CPU 31 at S307 stops supply of the electric power from the host device. Specifically, the CPU 31 sends the power switcher 50 a signal for switching the first switch 52 from the closed state to the open state. When the first switch 52 is opened, the supply of the electric power from the USB-connected host device is stopped.

That is, in this MFP 100, in the case where the power switcher 50 is receiving the electric power from the commercial power source, the CPU 31 limits the supply of the electric power from the host device and uses only the electric power supplied from the commercial power source. This operation reduces a possibility of an overcurrent passing through the host device even in the event of a sudden stop of the power supply from the commercial power source, for example. It is noted that the MFP 100 is capable of detecting the presence or absence of the USB plug inserted in the USB connector 70 even in the state in which the supply of the electric power from the host device is limited.

The CPU 31 at S308 transmits the response signal for responding to the response request signal transmitted from the host device. That is, in the case where the MFP 100 is receiving the electric power from the commercial power source, the MFP 100 limits the supply of the electric power from the host device but does not limit communication with the host device using signals. The processings at S307 and S308 may be executed in reverse order and may be executed at the same time.

After the processing at S308 or when the CPU 31 determines that there is no host device connected to the MFP 100 through USB (S306: NO), the CPU 31 at S310 switches the power supply mode from the second mode to the third mode. Specifically, as indicated by STATE 3 in FIG. 4, the CPU 31 transmits, to the power switcher 50, (i) an instruction for switching the first switch 52 from the closed state to open state, (ii) an instruction for switching the third switch 54 from the open state to the closed state, and (iii) an instruction for switching the fourth switch 55 from the open state to the closed state.

As a result, the state of the MFP 100 becomes the third mode in which supply of the electric power to the devices including the image processor 10 is not limited. When the MFP 100 accepts an instruction made by the user, the MFP 100 performs a normal operation according to the instruction. The normal operation may be an operation including image processing. Examples of the normal operation include printing, copying, and scanning. Other examples of the normal operation include: processings for various inputs using the operation panel 40; reception of data from the device connected to the MFP 100 through USB; and transmission of data to the device connected to the MFP 100 through USB.

The CPU 31 at S312 determines whether the power-source key 60 has been operated. When the power-source key 60 is operated, as described above, the fifth switch 56 (see FIG. 2) of the power switcher 50 is closed, and a signal indicating the operation of the power-source key 60 is input to the controller 30. When the CPU 31 determines that the power-source key 60 has not been operated (S312: NO), the CPU 31 keeps operating in the third mode.

When the CPU 31 determines that the power-source key 60 has been operated (S312: YES), the CPU 31 at S305 switches the power supply mode from the third mode to the first mode, and the commercial electric power process ends. Specifically, the CPU 31 instructs the power switcher 50 to switch each of the second switch 53, the third switch 54, and the fourth switch 55 from the closed state to the open state. As a result, no electric power is supplied to the controller 30, so that the CPU 31 cannot execute the process. Thus, the commercial electric power process ends.

It is noted that in the case where the electric power is being supplied from the commercial power source and where the power-source key 60 is operated again after the power supply mode is switched to the first mode in response to an operation of the power-source key 60, the fifth switch 56 is closed in response to the operation of the power-source key 60, so that supply of the electric power to the controller 30 is started. The CPU 31 is then activated and starts executing the mode transition process. In this case, since the CPU 31 determines that the MFP 100 is receiving the electric power from the commercial power source, the CPU 31 switches the power supply mode to the third mode. Specifically, the CPU 31 instructs the power switcher 50 to switch each of the second switch 53, the third switch 54, and the fourth switch 55 from the open state to the closed state.

While FIG. 6 illustrating the second mode process and FIG. 7 illustrating the commercial electric power process illustrate "RETURN" as the last processing, these processes are terminated in response to transition to the first mode or stop of supply of the electric power to the MFP 100. That is, since the execution of these processes is stopped in response to a stop of the supply of the electric power to the CPU 31, the CPU 31 does not return to the mode transition process in reality. When the supply of the electric power to the CPU 31 is thereafter started again, the CPU 31 starts executing the mode transition process.

It is noted that the CPU 31 does not change the power supply mode during the second mode process even when the power-source key 60 is operated. For example, the MFP 100 may be configured such that the signal indicating the operation of the power-source key 60 is not input to the controller 30 in the state in which electric power is supplied only from the USB-connected host device. Alternatively, the CPU 31 may execute no processings even when the signal indicating the operation of the power-source key 60 is input during execution of the second mode process. This configuration enables the CPU 31 to continue the second mode process even if the power-source key 60 is pressed during operations of the packed MFP 100 in the second mode, for example.

The MFP 100 as described above receives the electric power supplied from the commercial power source and the electric power supplied from the USB-connected host device and supplies the electric power to the image processor 10 and the controller 30. In the case where the state of the MFP 100 is changed from a state in which no electric power is received from the commercial power source and the host device to a state in which electric power is received from at least one of the commercial power source and the host device, the MFP 100 starts supplying the electric power in the second mode in which the electric power is to be supplied to the controller 30 and not to be supplied to the image processor 10. This operation activates the CPU 31, and when the MFP 100 is not receiving the electric power from the commercial power source, and the switch information 341 is the first information, the CPU 31 switches the power supply mode from the second mode to the first mode. In the operations in the second mode, image processing is not executed, but electric power is consumed, resulting in useless power consumption in the user environment. In the case where the switch information 341 is the first information, the operations of the MFP 100 in the second mode are limited, so that the MFP 100 is operated in the second mode with a low frequency. Accordingly, when compared with the case where the operations in the second mode are not limited even in the user environment, for example, the MFP 100 is operated in the second mode with a low frequency, resulting in reduction of useless consumption of the electric power.

While the embodiment has been described above, it is to be understood that the disclosure is not limited to the details of the illustrated embodiment, but may be embodied with various changes and modifications, which may occur to those skilled in the art, without departing from the spirit and scope of the disclosure. For example, the present disclosure is applied to the MFP in the above-described embodiment but may be applied to any apparatuses having the image processing function and capable of receiving electric power supplied from the commercial power source and electric power supplied from a power source of a device connected to the apparatus through USB. Examples of the apparatuses include copying machines, printers, scanners, and facsimile machines.

The second mode may be any mode as long as no electric power is supplied to the image processor 10. A target to which electric power is to be supplied in the second mode is not limited to the entire controller 30. For example, electric power may be supplied in the second mode only to a portion of the controller 30 and may be supplied to a device other than the controller 30 such as a portion of the operation panel 40.

The determination of the time-out at S203 in the second mode process may be omitted. That is, the CPU 31 may wait for transmission of the command until the plug is removed from the USB connector 70. However, the determination of the time-out is preferably executed because of possible reduced consumption of electric power. Also, the specific length of time used for the determination of the time-out may be any of a fixed time and a variable time.

In the second mode process, the order of the determinations for the presence or absence of reception of the various kinds of commands is not limited to that in the above-described embodiment. That is, the order of the processings at S206, S208, and S210 in the second mode process may be any order. In the second mode process, when a job including image processing is received, the job is read and deleted in the above-described embodiment but may be stored into the RAM 33.

The waveform signal for detecting the zero-crossings may also be received during the second mode process. When the CPU 31 determines that supply of the electric power from the commercial power source is started during the second mode process, the CPU 31 may suspend the second mode process to start executing the commercial electric power process.

In the commercial electric power process, the switch information 341 is automatically switched to the first information but may not be switched. That is, the processings at S301 and S302 may be omitted. For example, the switch information 341 may be changed only by a command transmitted from a PC, for example. However, the automatic change in response to supply of the electric power from the commercial power source is preferable for reducing occasions of operations in the second mode in the user environment.

In the present embodiment, the contents in a particular storage area for the switch information 341 are changed, but the storage area may not be provided in advance. For example, when the CPU 31 determines that the power supply mode is switched to the first mode without supply of the electric power in the second mode, information indicating this determination may be newly stored. In this case, the CPU 31 can determine whether the power supply mode is switched to the first mode, or the electric power is to be supplied in the second mode, based on whether the information is stored. Alternatively, the information may be stored when the CPU 31 determines that the electric power is to be supplied in the second mode without switching the power supply mode to the first mode.

In the above-described embodiment, the CPU 31 of the controller 30 determines, based on the waveform signal of the alternating-current power, whether the electric power is being supplied from the commercial power source. However, instead of using the waveform signal, the MFP 100 may detect a voltage value and/or a current value and determine whether the electric power is being supplied from the commercial power source, for example.

The power-source key 60 is not limited to the momentary switch and may be an alternate switch. For example, the power-source key 60 may be a mechanically movable switch. When the CPU 31 determines that the MFP 100 is receiving the electric power from the commercial power source, the CPU 31 may determine, based on the position of the power-source key 60, whether the power supply mode is switched to the third mode or the first mode. While only the operation of the power-source key 60 is accepted in the first mode in the above-described embodiment, an operation of the operation panel 40 may also be accepted.

The processings in the above-described embodiment may be executed by hardware such as a single CPU, a plurality of CPUs, and an ASIC or combination thereof. Also, the processings in the above-described embodiment may be executed in various forms such as a non-transitory storage medium storing instructions for executing the processings and methods for executing the processings.

What is claimed is:

1. An image processing apparatus, comprising:

an image processor configured to perform image processing;

a storage;

a power switcher comprising (i) a first connector connected to a commercial power source to receive electric power and (ii) a second connector connected to a power source of a bus-connected device to receive electric power; and a controller, wherein the power switcher is selectively in one of at least three power supply modes, each of which is a mode of supply of the electric power from at least one of the commercial power source and the bus-connected device, wherein the at least three power supply modes comprise:

a first mode in which no electric power is supplied to any of the controller and the image processor;

a second mode in which the electric power is supplied to the controller, and no electric power is supplied to the image processor; and a third mode in which the electric power is supplied to the controller and the image processor, wherein the power switcher is configured to start supplying the electric power in the second mode when a state of the power switcher is changed from a state in which the power switcher receives no electric power from any of the commercial power source and the power source of the bus-connected device, to a state in which the power switcher receives the electric power from at least one of the commercial power source and the power source of the bus-connected device, and wherein the controller is configured to:

determine whether the power switcher is receiving the electric power from the commercial power source, when a state of the controller is switched from a state in which no electric power is supplied to the controller to a state in which the electric power is supplied to the controller in the second mode; and when the controller determines that the power switcher is receiving no electric power from the commercial power source, execute, based on particular information stored in the storage, one of (a) switching the power supply mode of the power switcher from the second mode to the first mode before execution of a first processing and (b) switching the power supply mode of the power switcher from the second mode to the first mode after execution of the first processing.

2. The image processing apparatus according to claim 1, wherein the controller is configured to:

switch the power supply mode of the power switcher from the second mode to the first mode before execution of the first processing, when the controller determines that the power switcher is receiving no electric power from the commercial power source and when the particular information stored in the storage is first information; and switch the power supply mode of the power switcher from the second mode to the first mode after execution of the first processing when the controller determines that the power switcher is receiving no electric power from the commercial power source and when the particular information stored in the storage is second information different from the first information.

3. The image processing apparatus according to claim 2, wherein the controller is configured to store the first information into the storage as the particular information, when the controller determines that the power switcher is receiving the electric power from the commercial power source.

4. The image processing apparatus according to claim 2, wherein the controller is configured to accept a storage instruction from the bus-connected device in a period in which the electric power is being supplied in the second mode, and the storage instruction is for storing the first information into the storage as the particular information.

5. The image processing apparatus according to claim 1, wherein the first processing is at least one of:

a processing based on a rewriting instruction transmitted from the bus-connected device for a rewrite of the particular information stored in the storage to the first information;

a processing based on an instruction transmitted from the bus-connected device for a rewrite of a firmware; and a processing for deleting a job that is received from the bus-connected device to cause the image processor to perform the image processing.

6. The image processing apparatus according to claim 1, wherein the controller is configured to limit supply of the electric power by the power switcher from the second connector without limiting input of a signal from the bus-connected device to the controller when the controller determines that the power switcher is receiving the electric power from the commercial power source.

7. The image processing apparatus according to claim 1, wherein the power switcher is configured to, based on the electric power supplied to the first connector, create a waveform signal for detecting a zero-crossing at which an absolute value of an alternating voltage is zero, and wherein the controller is configured to determine that the power switcher is receiving the electric power from the commercial power source, when the controller determines, based on the waveform signal, that the number of the zero-crossings per unit time is greater than a particular value.

8. The image processing apparatus according to claim 1, wherein the controller is configured not to execute a job for causing the image processor to perform the image processing, when the controller accepts the job from the bus-connected device in a period in which the electric power is being supplied in the second mode.

9. The image processing apparatus according to claim 1, wherein the controller is configured to execute a rewriting processing for rewriting one of a firmware and setting information, when the controller accepts an instruction for execution of the rewriting processing as the first processing, from the bus-connected device in a period in which the electric power is being supplied in the second mode.

10. The image processing apparatus according to claim 1, wherein the controller is configured to switch the power supply mode of the power switcher from the second mode to the first mode when a state in which no signal is received from the bus-connected device has continued for greater than or equal to a specific length of time in a period in which the electric power is being supplied in the second mode.

11. The image processing apparatus according to claim 1, wherein the controller is configured not to transmit a response signal for responding to a response request signal even when the controller receives the response request signal from the bus-connected device before the power supply mode is switched from the second mode to the first mode, in a case where the controller determines, based on the particular information stored in the storage, that the power supply mode of the power switcher is to be switched to the first mode.

12. An image processing apparatus, comprising:

an image processor configured to perform image processing;

a storage;

a power switcher comprising (i) a first connector connected to a commercial power source to receive electric power and (ii) a second connector connected to a power source of a bus-connected device to receive electric power; and a controller, wherein the power switcher is selectively in one of at least three power supply modes, each of which is a mode of supply of the electric power from at least one of the commercial power source and the bus-connected device, wherein the at least three power supply modes comprise:

a first mode in which no electric power is supplied to any of the controller and the image processor;

a second mode in which the electric power is supplied to the controller, and no electric power is supplied to the image processor; and a third mode in which the electric power is supplied to the controller and the image processor, wherein the power switcher is configured to start supplying the electric power in the second mode when a state of the power switcher is changed from a state in which the power switcher receives no electric power from any of the commercial power source and the power source of the bus-connected device, to a state in which the power switcher receives the electric power from at least one of the commercial power source and the power source of the bus-connected device, and wherein the controller is configured to:

determine whether the power switcher is receiving the electric power from the commercial power source, when a state of the controller is switched from a state in which no electric power is supplied to the controller to a state in which the electric power is supplied to the controller;

determine, based on particular information stored in the storage, whether the power supply mode of the power switcher is to be changed to the first mode before execution of a first processing or after execution of the first processing;

switch the power supply mode of the power switcher from the second mode to the first mode before execution of the first processing, when the controller determines that the power switcher is receiving no electric power from the commercial power source and when the controller determines that the power supply mode of the power switcher is to be changed to the first mode before execution of the first processing; and switch the power supply mode of the power switcher from the second mode to the first mode after execution of the first processing, when the controller determines that the power switcher is receiving no electric power from the commercial power source and when the controller determines that the power supply mode of the power switcher is to be changed to the first mode after execution of the first processing.

13. The image processing apparatus according to claim 12, wherein the controller is configured to:

determine that the power supply mode of the power switcher is to be changed to the first mode before execution of the first processing, when the particular information stored in the storage is the first information; and determine that the power supply mode of the power switcher is to be changed to the first mode after execution of the first processing, when the particular information is second information different from the first information.

14. The image processing apparatus according to claim 12, wherein the first processing is at least one of: p1 a processing based on a rewriting instruction transmitted from the bus-connected device for a rewrite of the particular information stored in the storage to the first information;

a processing based on an instruction transmitted from the bus-connected device for a rewrite of a firmware; and a processing for deleting a job that is received from the bus-connected device to cause the image processor to perform the image processing.

* * * * *